United States Patent [19]

Becka

[11] 4,373,467

[45] Feb. 15, 1983

[54] MACHINE FOR APPLYING A PATCH OF ADHESIVE ONTO THE BOTTOM OF A LAST

[75] Inventor: Michael M. Becka, Nashua, N.H.

[73] Assignee: International Shoe Machine Corporation, Nashua, N.H.

[21] Appl. No.: 287,339

[22] Filed: Jul. 27, 1981

[51] Int. Cl.[3] ..... B05C 1/02

[52] U.S. Cl. ..... 118/211; 118/225; 118/241; 118/257

[58] Field of Search ..... 118/241, 257, 211, 225

[56] References Cited

U.S. PATENT DOCUMENTS 3,653,356 4/1972 Brastow ..... 118/241 X

*Primary Examiner*—John P. McIntosh

*Attorney, Agent, or Firm*—Albert Gordon

[57] ABSTRACT

A machine for applying a patch of adhesive onto the bottom of a last (94) comprising an adhesive applying member (89) movable downwardly into engagement with the last bottom and a shifting mechanism (34, 92) operative to so shift the adhesive applying mechanism during its downward movement as to cause the adhesive applying mechanism to engage the last bottom close to the toe end of the last.

2 Claims, 3 Drawing Figures

MACHINE FOR APPLYING A PATCH OF ADHESIVE ONTO THE BOTTOM OF A LAST

BACKGROUND OF THE INVENTION

U.S. patent application Ser. No. 262,665 filed May 11, 1981 shows a machine for applying patches of adhesive to the toe and heel seat portions of a last bottom which patches are utilized to adhere the toe and heel seat portions of an insole to the last bottom. The patches are applied by adhesive applying members that are moved into engagement with the last bottom. Subsequently, a completed shoe, that includes the insole, is fabricated on the last and the completed shoe, that includes the insole, is separated from the last. In this separation, the insole is separated from the last bottom thus breaking the bond between the last bottom and the insole formed by the adhesive. In this separation of the insole from the last bottom, remnants of the adhesive patch at the toe remain on the insole and irritate the foot of the wearer of this shoe. This potential irritation is not a problem with remnants of the adhesive patch on the heel seat portion of the insole as the heel seat portion of the insole, in the completed shoe, is covered by a heel pad that protects the wearer's foot from these remnants.

SUMMARY OF THE INVENTION

The purpose of this invention is to so locate the patch remnants on the toe portion of the insole as to avoid the irritation of the wearer's foot. This is accomplished by so shifting the adhesive applying member cooperative with the toe of the last that it engages the last bottom close to the toe end of the last bottom in a region that would not be engaged by the wearer's foot.

DESCRIPTION OF THE PREFERRED EMBODIMENT

Figure 1:
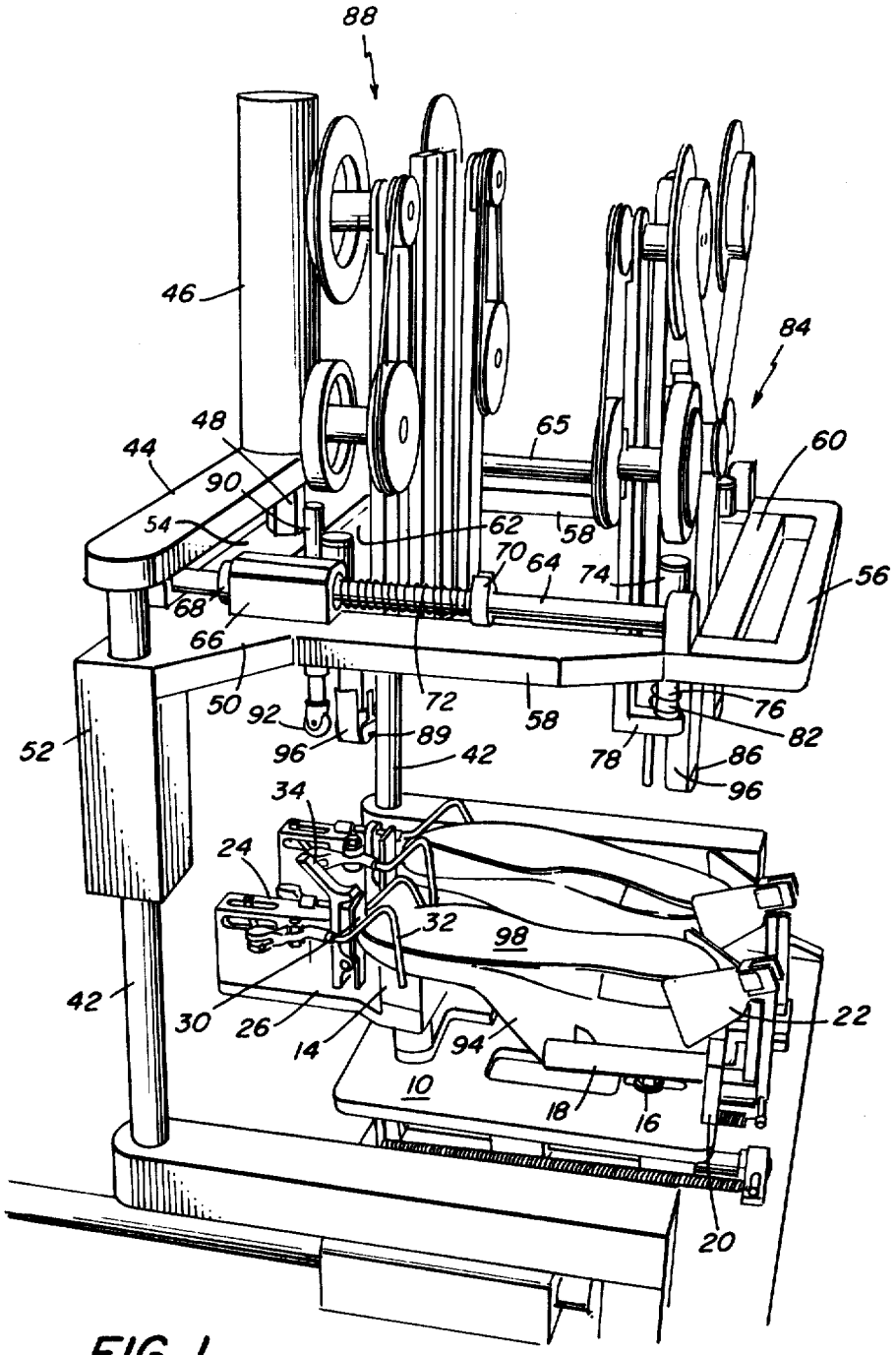
FIG. 1 is an isometric view of the machine of this invention.
Figure 2:
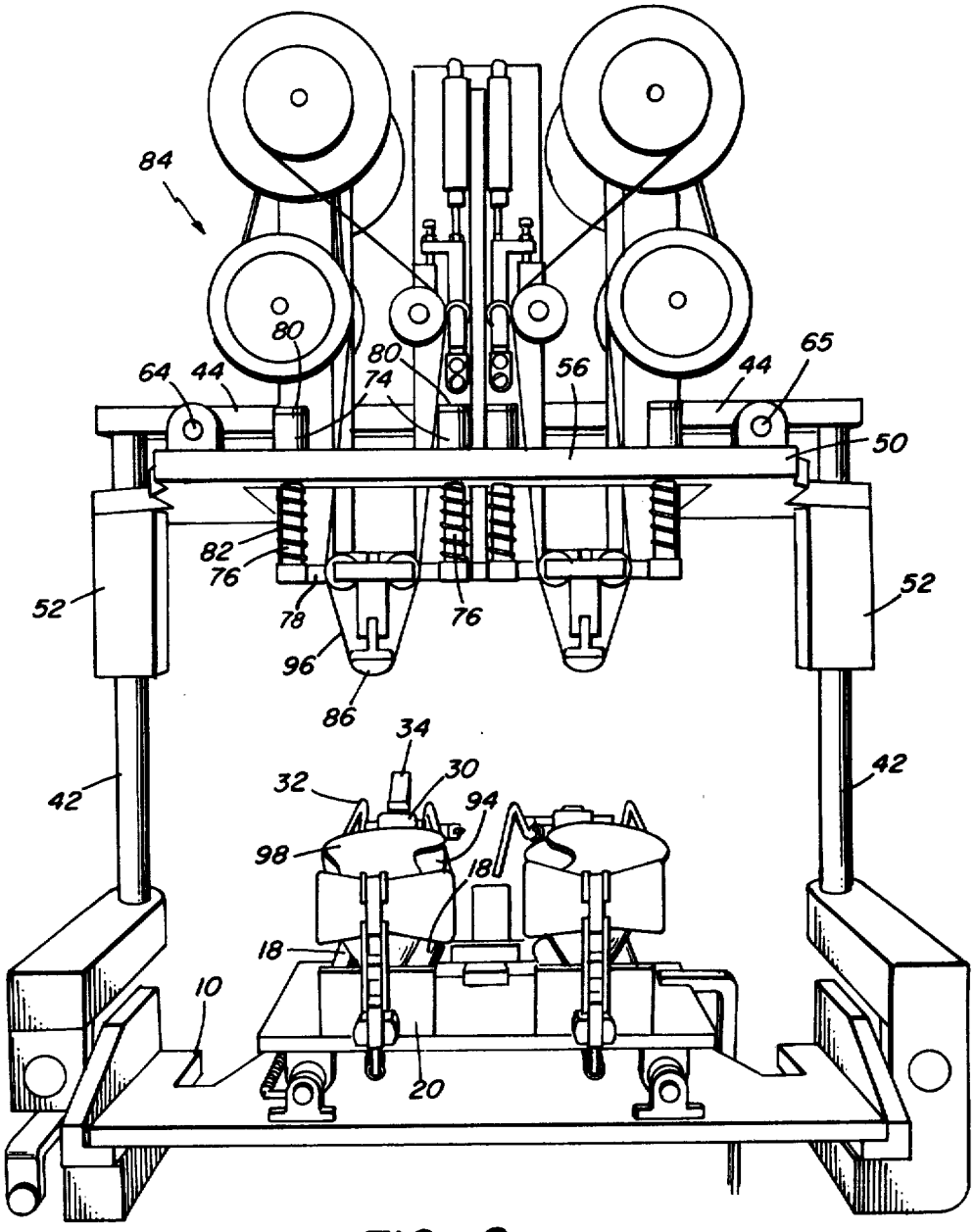
FIG. 2 is a front elevation view of the machine.

The operator is intended to stand to the right of the machine as seen in FIG. 1 and in front of the machine as seen in FIG. 2. The parts of the machine closest to the operator will be considered to be the front of the machine and the parts of the machine furthermost from the operator will be considered to be the back of the machine. Movements of machine elements towards the operator will be considered to be "forward" movements and movements of machine elements away from the operator will be considered to be "rearward" movements.

The machine is intended to operate on a left foot shoe assembly and a right foot shoe assembly. The machine therefore has two sets of mechanisms for operating on the shoe assemblies which are substantially duplicates of each other. Therefore, in the following description, it is to be understood that while reference is made to one mechanism this mechanism is duplicated in the machine.

Figure 3:
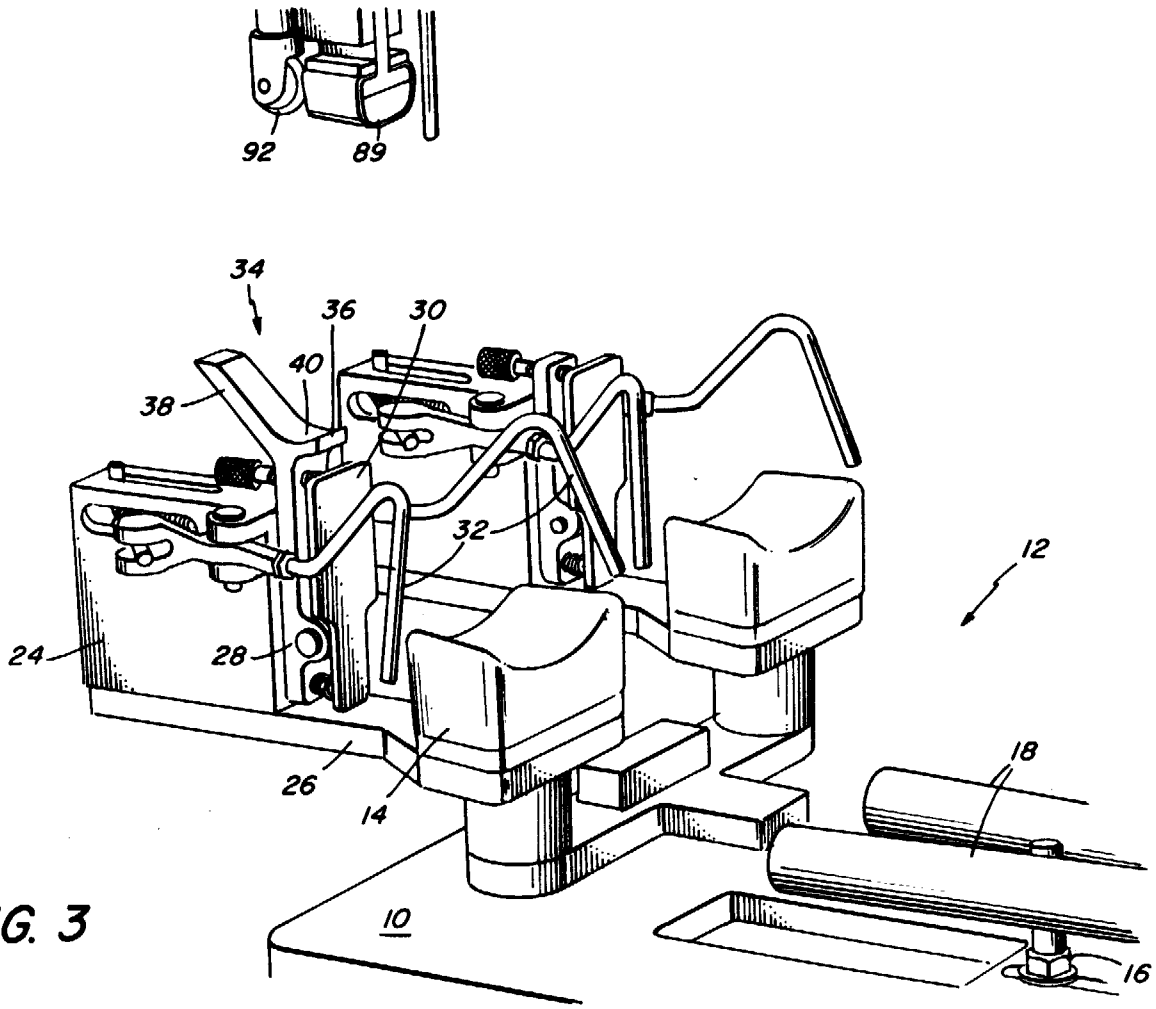
FIG. 3 is an isometric view of a last support and a mechanism for shifting the adhesive applying member.

Referring to FIGS. 1–3, the machine includes a plate 10 having a last support 12 mounted to its top. The last support 12 comprises a toe rest 14, a last pin 16, and bars 18, affixed to a bracket 20, that extend in forward-rearward directions on opposite sides of the last pin 16. A forked heel aligner 22 is located forwardly of the last pin 16 and is mounted to the plate 10 in the manner shown in U.S. application Ser. No. 262,665. A toe aligner 24 is mounted to the plate 10 and is located rearwardly of the toe rest 14 on a bar 26. The toe aligner 24, which is constructed similarly to the toe aligner 302 of U.S. application Ser. No. 262,665, includes a plate 28, a front aligner plate 30 mounted to and located forwardly of the plate 28, and side aligner pins 32. An upwardly concave cam 34 is mounted to the top of the plate 28. The cam 34 has a relatively short front leg 36 and a relatively long back leg 38, the legs 36 and 38 extending upwardly of a depression 40 located between the legs.

A pair of posts 42 are located on opposite sides of and extend upwardly of the plate 10. A cross plate 44 extends between and is fixedly mounted to the posts 42. A pneumatic motor 46 is mounted to the center of the cross plate 44. The downwardly directed piston rod 48 of the motor 46 is secured to a frame 50. Bearings 52 of the frame 50 are slidable on the posts 42 to guide the frame 50 for heightwise movement in response to actuations of the motor 46.

The frame 50 has a back 54 to which the piston rod 48 is secured, a front 56, and sides 58. An empty space exists between the frame parts 54, 56 and 58. A front cross support 60, fixedly secured to the sides 58, extends between the sides 58 rearwardly of the front 56. A back cross support 62 extends between the sides 58 forwardly of the back 54 and rearwardly of the cross support 60. A rod 64 is mounted to one of the sides 58 and a rod 65 is mounted to the other side 58, the rods 64 and 65 extending in forward-rearward directions over their associated sides. A sleeve 66 is slidably mounted on each of the rods 64 and 65 and is fixed to the back cross support 62 to thereby mount the support 62 for forward-rearward movement. A back collar 68 and a front collar 70 are secured to the rod 64 and a compression spring 72 is entwined about the rod 64 between the collar 70 and the sleeve 66 on the rod 64 to thereby yieldablyl urge this sleeve 66, together with the back cross support 62, rearwardly against the collar 68.

As shown particularly in FIG. 2, a pair of spaced sleeves 74 are fixedly mounted to the front support 60. A rod 76 extends through each sleeve 74 and downwardly of the front support 60. The bottoms of the rods 76 are secured to a plate 78 and a cap 80 is secured to the top of each rod 76 and overlies its associated sleeve 74. A compression spring 82 is entwined about each rod 76 between the plate 78 and the front support 60 to yieldably urge the plate 78 downwardly to a limit determined by the engagement of the caps 80 with the tops of the sleeves 74.

A front adhesive applying mechanism 84 is mounted to the plate 78. The adhesive applying mechanism 84 is constructed similarly to the front adhesive applying mechanism 346 of U.S. application Ser. No. 262,665 with the plate 78 corresponding to the plate 360 of U.S. application Ser. No. 262,665. The adhesive applying mechanism 84 includes an applicator pad 86 corresponding to the applicator 378 of U.S. application Ser. No. 262,665.

A back adhesive applying mechanism 88, constructed similarly to the back adhesive applying mechanism 354 of U.S. application Ser. No. 262,665, is mounted to the back support 62 in substantially the same manner as the mounting of the front adhesive applying mechanism 84 to the front support 60. The back adhesive applying mechanism 88 also includes a plate 78, that is yieldably urged downwardly of the back support 62 by springs 82, and an applicator pad 89. A tube 90 is rigidly mounted to the back support 62 and extends downwardly thereof rearwardly of the applicator pad 89 and a cam follower 92 is so mounted in the tube 90 as to be yieldably urged downwardly of the tube 90 by a spring in the tube 90. As shown most clearly in FIG. 3, the cam follower 92 is in general registration with the cam 34.

In the idle condition of the machine, the piston rod 48 is retracted into the motor 46 so that the frame 50 and the adhesive applying mechanisms 84 and 88 are in upper positions.

At the beginning of the machine cycle, a last 94 is so placed bottom-up on the last support 12 that the last pin 16 enters the thimble hole in the last 94, the forepart of the last 94 is supported on the toe rest 14 and the bars 18 support the sides of the heel portion of the last 94. When so supported, the toe of the last faces rearwardly and the heel of the last faces forwardly.

In the idle condition of the machine, the heel aligner 22 in a forward position disengaged from the last 94 and the toe aligner 24 is so set that the aligner plate 30 is in a rearward position and the aligner pins 32 are in outer positions disengaged from the last 94.

During the machine cycle, in the manner shown in U.S. application Ser. No. 262,665, the heel aligner 22 is moved rearwardly into engagement with the heel end of the last 94 and the toe aligner 24 is so actuated as to move the aligner plate 30 forwardly into engagement with the toe end of the last 94 and as the move the aligner pins 32 inwardly into engagement with the sides of the forepart of the last 94. This forward movement of the aligner plate 30 acts to also move the cam 34 forwardly to a position determined by the location of the toe end of the last 94.

Now the motor 46 is actuated to lower its piston rod 48 to thereby lower the frame 50 into a lower position which causes a lowering of the adhesive applying mechanisms 84 and 88. In the idle position of the machine, the back adhesive applying mechanism 88 is in a relatively rearward position determined by the position of engagement of the sleeve 66 with the collar 68 under the influence of the spring 72. The cam 34, the aligner plate 30 and the cam follower 92 are so related that at this time the cam follower 92 is situated above the back leg 38 of the cam 34 so that, pursuant to the lowering of the back adhesive applying mechanism 88, the cam follower 92 will engage the back leg 38, the specific forward-rearward area of this engagement being dependent on the forward-rearward position of the aligner plate 30 in its position of engagement with the toe end of the last 94. The position of engagement of the aligner plate 30 with the toe end of the last 94 is dependent on the forward-rearward distance between the last pin 16 and the toe end of the last 94 and, therefore, upon the length of the last 94. After engagement of the cam follower 92 with the back leg 38, the cam follower will move forwardly and downwardly along the back leg until it settles in the depression 40. This forward movement of the cam follower 92 causes corresponding forward movement of the back adhesive applying mechanism 88 including the applicator pad 89, with the sleeve 66 moving forwardly against the force of the spring 72. During the forward movement of the cam follower 92 along the back leg 38 of the cam 34, and after the settling of the cam follower 92 in the depression 40, the pads 86 and 89 continue to descend along with the frame 50 with the cam follower 92 retracting into the tube 90 until the applicator pad 86 engages the heel seat portion of the bottom of the last 94 and the applicator pad 89 engages the forepart portion of the bottom of the last 94 close to and heelwardly of the toe end extremity of the last bottom. After the engagement of the applicator pad 86 with the last bottom, the continued downward movement of the frame 50 causes the plate 78 associated with the front adhesive applying mechanism 84 and its associated rods 76 and the front adhesive applying mechanism 84 to rise against the force of its associated springs 82. After the engagement of the applicator pad 89 with the last bottom, the continued downward movement of the frame 50 causes the plate 78 associated with the back adhesive applying mechanism 88 and its associated rods 76 and the back adhesive applying mechanism 88 to rise against the force of its associated springs 82. After the engagement of the applicator pads 86 and 89 with the bottom of the last 94, the motor 46 is actuated to raise the piston rod 48 to thereby raise the frame 50 and the adhesive applying mechanisms 84 and 88 to their idle positions with the applicator pads 86 and 89 rising away from the bottom of the last 94.

As disclosed in U.S. application Ser. No. 262,665, a tape 96 is draped about each of the applicator pads 86 and 89. The tape 96 is so constituted as to transfer a patch of adhesive therefrom onto the last bottom pursuant to the engagement of the applicator pads 86 and 89 with the last bottom. The adhesive patch transferred by the applicator pad 86 is located on the heel seat portion of the last bottom. The adhesive patch transferred by the applicator pad 89, because of the aforementioned coaction of the cam follower 92 with the cam 34 and the aforementioned position of the aligner plate 30 and the cam depression 40 with respect to the toe end extremity of the last 94, will be close to and heelwardly of the toe end extremity of the last 94 regardless of the length of the last.

Now, in the manner disclosed in U.S. application Ser. No. 262,665, the heel aligner 22 and the toe aligner 24 are returned to their idle positions so that the heel aligner and the aligner plate 30 and the aligner pins 32 are disengaged from the last 94.

As disclosed in U.S. application Ser. No. 262,665, the machine molds an initially flat insole 98 to a shape that is at least approximately the shape of the bottom of the last 94, enables the molded insole to be placed on the last bottom and so positions that plate 10 and the last 94, as shown in FIGS. 2 and 3, that they bear the same relationship to the frame 50 and the adhesive applying mechanisms 84 and 88 as they did when the adhesive patches were transferred onto the last bottom by the adhesive applying members 86 and 89.

Now the heel aligner 22 is again moved rearwardly into engagement with the heel end of the last 94 and the toe aligner 24 is again actuated as to move the aligner plate 30 into engagement with the toe end of the last 94 and as to move the aligner pins 32 inwardly into engagement with the sides of the last 94. These engagements of the members 22, 30 and 32 with the last 94 shift the insole 98, if it is not in exact registry with the last bottom, into exact registry with the last bottom.

After this, the motor 46 is again actuated to lower and then raise its piston rod 48 to cause a lowering and raising of the frame 50 and the adhesive applying mechanisms 84 and 88 as described above to cause the applicator pads 86 and 89 to engage and apply pressure to the insole 98 above the adhesive patches that were previously applied to the last bottom, and to then cause the raising of the applicator pads 86 and 89. This pressure applied by the applicator pads 86 and 89 functions to press the insole 98 against the last bottom and cause the insole 98 to adhere to the last bottom by means of the adhesive patches. This is followed by the return of the heel aligner 22 and the toe aligner 24 to their idle positions.

The machine cycle is now completed and the last 94 with the molded insole 98 secured to its bottom by the adhesive patches is removed from the machine. By conventional means, a shoe is completed on the last and the completed shoe is separated from the last. Pursuant to the separation of the completed shoe from the last, the insole is separated from the last bottom, thus breaking the bond between the last bottom and the insole formed by the adhesive patches. In this separation of the insole from the last bottom, remnants of the adhesive patches may remain on the insole and irritate the foot of the wearer of the shoe. In order to minimize the irritation by the adhesive patch applied by the applicator pad 89, this patch, by the mechanism described above, is applied close to the toe end of the insole where it is unlikely to be engaged by the wearer's foot. The heel seat portion of the insole is usually covered by a heel pad that protects the wearer's foot from being irritated by the adhesive patch applied by the applicator pad 86.

There follows a recapitulation of those aspects of the machine and its mode of operation that are germane to this invention.

The machine has the purpose of applying a patch of adhesive onto the bottom of the last 94 prior to bonding the insole 98 to the last bottom by means of the adhesive patch. The machine comprises: the last support 12 for supporting the last 94 bottom-up with its toe end facing rearwardly; the adhesive applying member 89, located above the last bottom, mounted for heightwise movement; the toe end contacting member 30 mounted for yieldable forward movement from a rearward idle position spaced from the toe end of the last 94 into a position of engagement with the toe end of the last; means, comprised of the motor 46 and its appropriate controls (not shown) for initially positioning the adhesive applying member 89 in an upper idle position spaced from the last bottom; and means, comprised of the motor 46 and its appropriate controls (not shown) for thereafter effecting downward movement of the adhesive applying member 89 towards the last bottom to enable the adhesive applying member 89 to engage the last bottom and apply the patch of adhesive onto the last bottom.

The machine described in the preceding paragraph is improved, in accordance with this invention, by comprising: means, shown in U.S. application Ser. No. 262,665, for yieldably moving the toe end contacting member 30 forwardly from its idle position into engagement with the toe end of the last 94 prior to effecting the downward movement of the adhesive applying member 89; means, comprised of the rod 64 and the sleeve 66, mounting the adhesive applying member 89 for forward-rearward movement; means, formed by the spring 72, yieldably urging the adhesive applying member 89 to a rearward position; and cooperative shifting means, comprised of the cam 34 and the cam follower 92, mounted to the toe end contacting member 30 and mounted for heightwise movement with the adhesive applying member 89 effective to shift the adhesive applying member 89 forwardly during its downward movement an amount such as to cause the adhesive applying member 89 to engage the last bottom close to and rearwardly of the toe end of the last bottom.

The cooperative shifting means comprises: the cam 34, mounted to the toe end contacting member 30 for forward-rearward movement therewith, having an upper surface on its leg 38 that slopes downwardly and forwardly into the depression 40; and the cam follower 92 so mounted for heightwise and forward-rearward movement in unison with the adhesive applying member 89 that it is in heightwise registry with the cam 34 when the toe end contacting member 30 is in engagement with the toe end of the last 94; whereby during the downward movement of the adhesive applying member 89 the cam follower 92 engages the cam 34 and moves forwardly along said upper surface into the depression 40 to thereby shift the adhesive applying member 89 forwardly as aforesaid.

I claim:

1. A machine for applying a patch of adhesive onto the bottom of a last prior to bonding an insole to the last bottom by means of the adhesive patch comprising: a last support for supporting the last bottom-up with its toe end facing rearwardly; an adhesive applying member, located above the last bottom, mounted for heightwise movement; a toe end contacting member mounted for yieldable forward movement from a rearward idle position spaced from the toe end of the last into a position of engagement with the toe end of the last; means for initially positioning the adhesive applying member in an upper idle position, spaced from the last bottom; and means for thereafter effecting downward movement of the adhesive applying member towards the last bottom to enable the adhesive applying member to engage the last bottom and apply the patch of adhesive onto the last bottom; characterized in that the machine comprises: means for yieldably moving the toe end contacting member forwardly from its idle position into engagement with the toe end of the last prior to effecting the downward movement of the adhesive applying member; means mounting the adhesive applying member for forward-rearward movement; means yieldably urging the adhesive applying member to a rearward position; and cooperative shifting means, formed of a first portion mounted to the toe end contacting member and formed of a second portion mounted for heightwise movement with the adhesive applying member, effective to shift the adhesive applying member forwardly during its downward movement an amount such as to cause the adhesive applying member to engage the last bottom close to and rearwardly of the toe end of the last bottom.

2. The machine according to claim 1 wherein the first portion comprises: a cam, mounted to the toe end contacting member for forward-rearward movement therewith, having an upper surface that slopes downwardly and forwardly into a depression; and wherein the second portion comprises: a cam follower so mounted for heightwise and forward-rearward movement in unison with the adhesive applying member that it is in heightwise registry with the cam when the toe end contacting member is in engagement with the toe end of the last; whereby during the downward movement of the adhesive applying member the cam follower engages the cam and moves forwardly along said upper surface into the depression to thereby shift the adhesive applying member forwardly as aforesaid.

* * * * *